United States Patent [19]

Rathke

[11] Patent Number: 4,644,251

[45] Date of Patent: Feb. 17, 1987

[54] DUAL VOLTAGE TRACKING CONTROL DEVICE

[75] Inventor: William M. Rathke, Arlington Heights, Ill.

[73] Assignee: Motorola, Inc., Schaumburg, Ill.

[21] Appl. No.: 718,263

[22] Filed: Apr. 1, 1985

[51] Int. Cl.[4] ..... G05F 1/577

[52] U.S. Cl. ..... 323/267; 323/268; 307/34

[58] Field of Search ..... 307/34, 82; 323/267, 323/268

[56] References Cited

U.S. PATENT DOCUMENTS

| | | | |
|---|---|---|---|
| 4,189,670 | 2/1980 | Tanahashi | 323/267 |
| 4,300,090 | 11/1981 | Weber | 323/267 |
| 4,549,255 | 10/1985 | Minamishima | 323/267 |

OTHER PUBLICATIONS

Shulz, "Dual Polarity Precision Reference Voltage Supply", IBM Technical Disclosure Bulletin, vol. 13, No. 10, p. 2944.

Feebeck et al., "Dual Voltage, Opposite-Tracking Regulator", IBM Technical Disclosure Bulletin, vol. 13, No. 10, p. 2636.

Choudhari, "Adjustable Tracking Voltage Regulator", Wireless World, Apr. 1978, vol. 84, No. 1508, p. 61.

Arnoldt, "Tracking Dual Voltage Regulator", Funkschan, vol. 51, No. 13, Jun. 22, 1979, p. 775.

de Jong, "Fully Protected Dual Power Supply", Electronics, vol. 41, No. 4, Jul. 1979, pp. 42–46.

*Primary Examiner*—Patrick R. Salce
*Assistant Examiner*—Jeffrey Sterrett
*Attorney, Agent, or Firm*—Steven G. Parmelee

[57] ABSTRACT

A dual tracking control device for use with a multiple voltage source system. The device provides a reference signal that may be used to control a voltage source, such that this voltage source will track another of the voltage sources, so long as the tracked voltage source maintains a predetermined relationship with respect to yet another voltage source. If this relationship is not maintained, then the tracking control device will cause the voltage source to track instead an alternative voltage source.

16 Claims, 4 Drawing Figures

DUAL VOLTAGE TRACKING CONTROL DEVICE

TECHNICAL FIELD

This invention relates generally to voltage supplies, and more particularly to voltage supplies used by circuit components that can be rendered inoperative if subjected to incorrect voltage inputs.

BACKGROUND ART

Many electrical components, such as integrated circuits, require connection to a voltage source separate and distinct from any incoming signals. Without such an independent voltage source, many of these components will not function properly. Many such components also have other inputs to receive stable voltage signals that may be used for reference purposes. For instance, some microprocessors (such as the INTEL 8097) have a $V_{cc}$ port for connection to a regulated 5 volt source, and a $V_{ref}$ port for receiving a stable reference voltage signal of 5 volts. The 8097 provides the latter input to ensure the availability of an accuate reference signal ($V_{ref}$) that can be compared with other inputs as received by the 8097. For instance, through this comparison process, the 8097 can accurately measure incoming sensor signals as may be received at the above noted inputs.

These needs could be accomodated by simply providing three separate regulated voltage sources; one for the $V_{cc}$ input, one for the $V_{ref}$ input, and one to supply voltage for the sensor inputs (a $V_{sensor}$ supply). Unfortunately, accuracy requirements often forbid such independance as between the $V_{sensor}$ source and the $V_{ref}$ source. If $V_{ref}$ and $V_{sensor}$ differ from one another by any appreciable amount, the microprocessor may not be able to correctly interpret the incoming sensor signals. Therefore, $V_{ref}$ and $V_{sensor}$ are often interelated to some extent to alleviate this source of inaccuracy.

With some components, however, such as the above mentioned 8097, this interelationship raises additional problems. For example, the 8097 may be disabled if the $V_{ref}$ signal differs greatly from the $V_{cc}$ signal. If the $V_{ref}$ signal tracks the $V_{sensor}$ signal, and the $V_{sensor}$ signal deviates from an accepted norm, the $V_{ref}$ signal will also deviate, causing a differential to grow between $V_{ref}$ and $V_{cc}$. This differential can, as noted above, disable the part.

There therefore exists a need for a voltage tracking control device that can be utilized with a multiple voltage source system such that a $V_{ref}$ signal can be provided that will track a $V_{sensor}$ voltage under ordinary operating conditions, but that will track the $V_{cc}$ signal under abnormal operating conditions to ensure that a microprocessor or other component as used in conjunction therewith will not be unnecessarily damaged during fault scenarios.

SUMMARY OF THE INVENTION

These needs and others are substantially met through provision of the dual tracking control device disclosed in this specification. This device has been designed to operate with a multiple voltage source system that includes at least a regulated voltage power source for providing a $V_{cc}$ signal, a first reference voltage source for providing a $V_{sensor}$ signal, and a second reference voltage source for providing a $V_{ref}$ signal.

The dual tracking control device functions to cause the $V_{ref}$ signal to substantially track the $V_{sensor}$ signal, so long as the $V_{sensor}$ signal maintains a predetermined relationship with respect to the $V_{cc}$ signal. If the $V_{sensor}$ signal does not maintain this relationship, the dual tracking control device will function to cause the $V_{ref}$ signal to track the $V_{cc}$ signal instead.

To better understand the functioning of the tracking control device, there are four fault conditions that may be considered.

First, the $V_{cc}$ signal may exceed its upper allowable limits and provide a signal having too high an amplitude. Under these circumstances, the relationship between the $V_{cc}$ signal and the $V_{sensor}$ signal can not be maintained, and the device will cause the $V_{ref}$ signal to track the $V_{cc}$ signal. Unfortunately, this over supply of voltage to a component, such as a microprocessor, will typically result in the destruction of the component. This result, however, would likely occur regardless of whether the $V_{ref}$ signal followed $V_{cc}$ or not, since the over supply of $V_{cc}$ voltage from the regulated voltage power source would tend to accomplish the same result in any event. Therefore, the device neither aids nor inhibits the likely disabling of the protected component under this fault condition.

In the second fault condition to be considered, the $V_{cc}$ signal drops below an acceptable minimum supply voltage. Again, under these circumstances, the $V_{cc}$ signal and the $V_{sensor}$ signal will not be within their predetermined relationship range, and the device will cause the $V_{ref}$ signal to track the falling $V_{cc}$ signal regardless of the amplitude of the $V_{sensor}$ signal. Under these conditions, the microprocessor or other protected component will likely cease functioning due to a lack of adequate supply voltage. The component will not, however, be destroyed due to an unacceptable variance between the $V_{cc}$ signal and the $V_{ref}$ signal. Therefore, as soon as the under voltage condition can be remedied, the component can be expected to return to a normal functioning mode.

The third fault condition to be considered presumes that the $V_{sensor}$ signal goes high. Again, the desired relationship between the $V_{sensor}$ signal and the $V_{cc}$ signal will be broken, and the device will cause the $V_{ref}$ signal to track the $V_{cc}$ signal. Therefore, although the $V_{sensor}$ signal has become unregulated and may result in erroneous sensor readings, the microprocessor or other component will remain functional and safe. The safety of the protected component would not necessarily be so assured if the $V_{ref}$ signal were made responsive only to the $V_{sensor}$ signal.

The final fault condition presumes that the $V_{sensor}$ signal drops low and again fails to maintain the desired relationship between itself and the $V_{cc}$ signal. The device will cause the $V_{ref}$ signal to track the $V_{cc}$ signal. As described above, the microprocessor or other component will again be protected from damage due to variances between the $V_{cc}$ signal and the $V_{ref}$ signal despite the nonregulation of the $V_{sensor}$ signal.

In summary, under ordinary operating conditions, the $V_{ref}$ signal will track the $V_{sensor}$ signal to thereby obtain the desired degree of accuracy for operations requiring a known initial relationship between the $V_{ref}$ signal and the $V_{sensor}$ signal. At the same time. The device can protect the protected component (such as a microprocessor) with respect to three of the four potential fault situations set forth above. As regards the one situation where the dual tracking control device cannot protect the protected component, this results largely because the fault condition in of itself creates a favorable liklihood of destroying the component in any event.

BRIEF DESCRIPTION OF THE DRAWINGS

These and other attributes of the invention will become more clear upon making a thorough review and study of the following description of the best mode for carrying out the invention, particularly when reviewed in conjunction with the drawings, wherein.

BEST MODE FOR CARRYING OUT THE INVENTION

Figure 1:
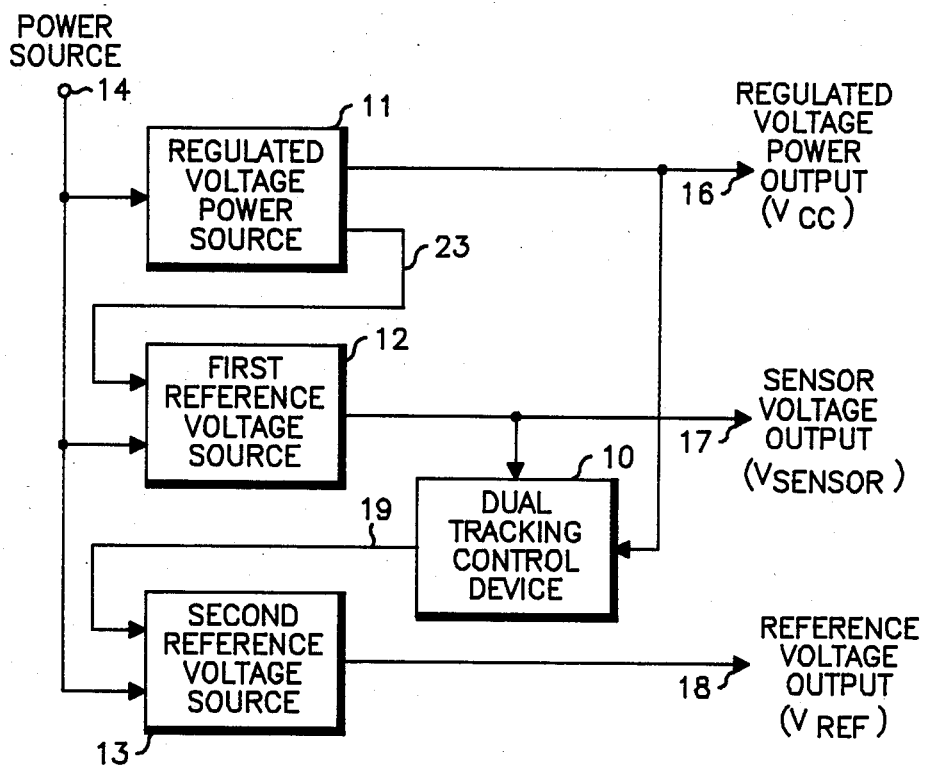
FIG. 1 comprises a block diagram view of the device as configured in conjunction with a multiple voltage source system.

Referring now to the drawings, and in particular FIG. 1, the dual tracking control device can be seen as depicted generally by numeral 10. The device (10) can be seen as configured in conjunction with a regulated voltage power source (11), a first reference voltage source (12), and a second reference voltage source (13).

A power source that provides a substantially unregulated DC voltage (14) such as an unregulated battery source provides power to the regulated voltage power source (11), the first reference voltage source (12), and the second reference voltage source (13). The output (16) of the regulated voltage power source (11) comprises a regulated voltage power output (such as a $V_{cc}$ signal). The output (17) of the first reference voltage source (12) provides a sensor voltage output (such as a $V_{sensor}$ signal). The output (18) of the second reference voltage source (13) provides a reference voltage output (such as a $V_{ref}$ signal).

The dual tracking control device (10) has an output (19) for providing a reference signal to the second reference voltage source (13). The device (10) also operably connects to the output (16) of the regulated voltage power source (11) and the output (17) of the first reference voltage source (12) such that the device (10) can be made responsive thereto.

Figure 2:
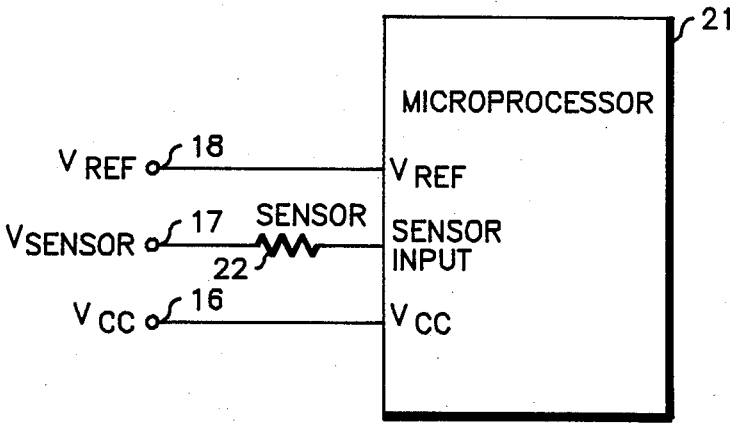
FIG. 2 comprises a block diagram view of a microprocessor as connected to receive the various voltage source signals depicted in FIG. 1.

Referring to FIG. 2, the output (16) of the regulated voltage power supply (11) may be utilized to provide a $V_{cc}$ signal to a microprocessor (21), the output (17) of the first reference voltage source (12) can be utilized to provide a $V_{sensor}$ signal to a sensor (22) that in turn connects to a sensor input of the microprocessor (21), and the output (18) of the second reference voltage source (13) can be utilized to provide a $V_{ref}$ signal to the microprocessor (21). So configured, the $V_{cc}$ signal provides operating power to the microprocessor (21), the $V_{sensor}$ signal provides a signal to drive the sensor inputs of the microprocessor (21), and the $V_{ref}$ signal provides a value that can be compared by the microprocessor (21) with the sensor input signals to allow accurate evaluation thereof.

Figure 3:
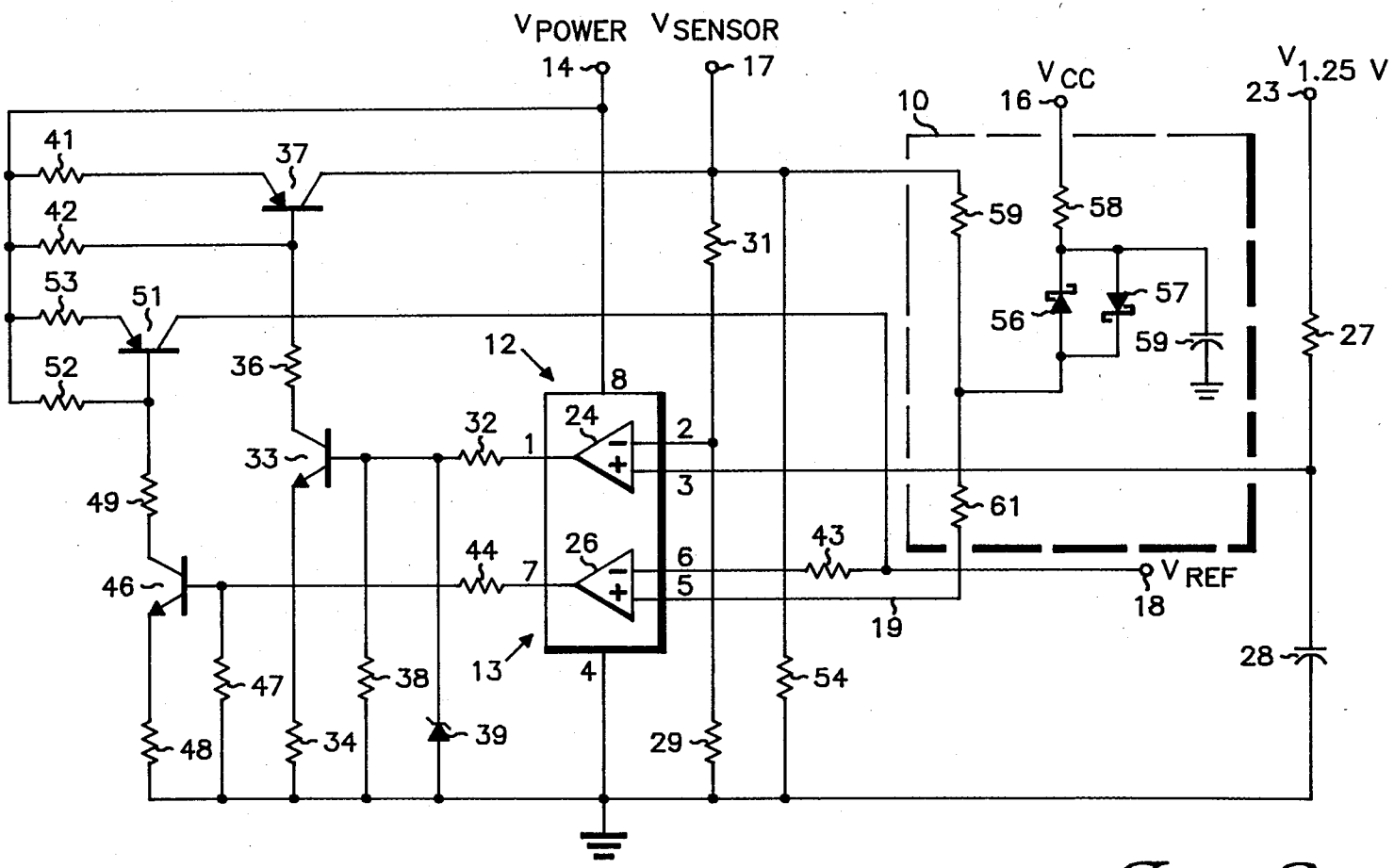
FIG. 3 comprises a schematic diagram of the dual tracking control device as configured in conjunction with a multiple voltage source system.

Referring now to FIG. 3, the specific components of the embodiment depicted in FIG. 1 will be described in detail.

The regulated voltage power source (11) (not shown in FIG. 3) can be provided through use of a 78540 as manufactured by Fairchild Semiconductor, Inc. Through use of this component, a $V_{cc}$ signal of 5 volts can be obtained at the output (16). In addition, this component has a 1.25 volt regulated reference voltage output (23) that can be beneficially utilized as explained below.

The first reference voltage source (12) and that second reference voltage source (13) are structured about first and second operational amplifiers (24 and 26) as may be provided through use of a 2904. The noninverting input of the first operational amplifier (24) connects: (a) through a 100 ohm current limiting resistor (27) to the 1.25 volt regulated reference voltage output (23) of the regulated voltage power source (11); and (b) to a grounded 0.47 microfarad capacitor (28). The inverting input of this operational amplifier (24) connects: (a) to ground through a 1.31K ohm resistor (29); and (b) through a 3.92K ohm feedback resistor (31) to the sensor voltage output (17).

The output of this operational amplifier (24) connects through a 360 ohm current limiting resistor (32) to the base of an SOT23 transistor (33), the emitter of which connects to ground through a 150 ohm resistor (34), and the collector of which connects through a 150 ohm resistor (36) to the base of a 2C5195 power transistor (37) as manufactured by Motorola. In addition, the base of the first mentioned transistor (33) connects to ground through a parallel combined 1.3K ohm resistor (38) and to a 4.7 volt Zener diode (39) (as provided through use of an MBZ5230).

The collector of the power transistor (37) provides the $V_{sensor}$ signal output (17), and also connects to a grounded 470 ohm resistor (54). The emitter of this transistor (37) connects to the $V_{power}$ source (14) through a 3.0 ohm ½ watt resistor (41). The base of this transistor (37) connects through a 100 ohm resistor (42) to the $V_{power}$ source (14).

Referring now to the second reference votage source operational amplifier (26) as identified above, the inverting input thereof connects through an 11K ohm resistor (43) to the reference voltage output (18). The noninverting input of this operational amplifier (26) connects to the dual tracking control device (10) as described in more detail below. The amplifier output connects: (a) through a 470 ohm resistor (44) to the base of an SOT23 transistor (46); and (b) through a 750 ohm resistor (47) to ground. The emitter of this transistor (46) connects to a grounded 100 ohm resistor (48), and the collector connects through a 100 ohm resistor (49) to the base of a 2C5195 power transistor (51) as manufactured by Motorola.

The base of the power transistor (51) connects through a 100 ohm resistor (52) to the $V_{power}$ source (14), and the emitter connects through a 10 ohm resistor (53) to the $V_{power}$ source (14). The collector of the power transistor (51) provides the reference voltage output (18).

The dual tracking control device (10) includes primarily two parallel configured back-to-back Schottky diodes (56 and 57) as provided through use of IN5818. One side of these parallel coupled diodes (56 and 57) connect: (a) through a 100 ohm resistor (58) to the regulated voltage power output ($V_{cc}$) (16); and (b) to a grounded 100 microfarad capacitor (59). The remaining side of these diodes (56 and 57) connects through: (a) a 10K ohm resistor (59) to the sensor voltage output (17); and (b) through a 1K ohm resistor (61) to the noninverting input of the second reference voltage source operational amplifier (26).

So configured, the first reference voltage source has a gain of 4, and will be responsive to the input of the 1.25 volt reference signal to yield a 5 volt signal at the sensor voltage output (17), such that the $V_{sensor}$ signal will substantially equal 5 volts. And, presuming that $V_{cc}$ substantially equals 5 volts, the output (19) of the device (10) will provide a 5 volt signal from the sensor voltage output (17) to the unity gain amplifier of the second reference voltage source (13), such that the $V_{ref}$ signal will closely track the $V_{sensor}$ signal.

If, however, the $V_{sensor}$ signal should deviate with respect to the $V_{cc}$ signal, one or the other of the Schottky diodes (56 and 57) will become active and cause the reference input (19) to the second reference voltage source (13) to track the $V_{cc}$ signal, plus or minus the small voltage drop of 0.27 volts as appears across the diodes (56 and 57).

Therefore, the $V_{ref}$ signal will closely track the $V_{sensor}$ signal during normal operation to ensure accuracy for comparative purposes. If the $V_{sensor}$ signal drifts out of regulation, or if the $V_{cc}$ signal becomes unregulated, the $V_{ref}$ signal will instead track the $V_{cc}$ signal to avoid the application of a disabling voltage differential to the microprocessor (21) (FIG. 2) or other protected component as may be utilized.

Figure 4:
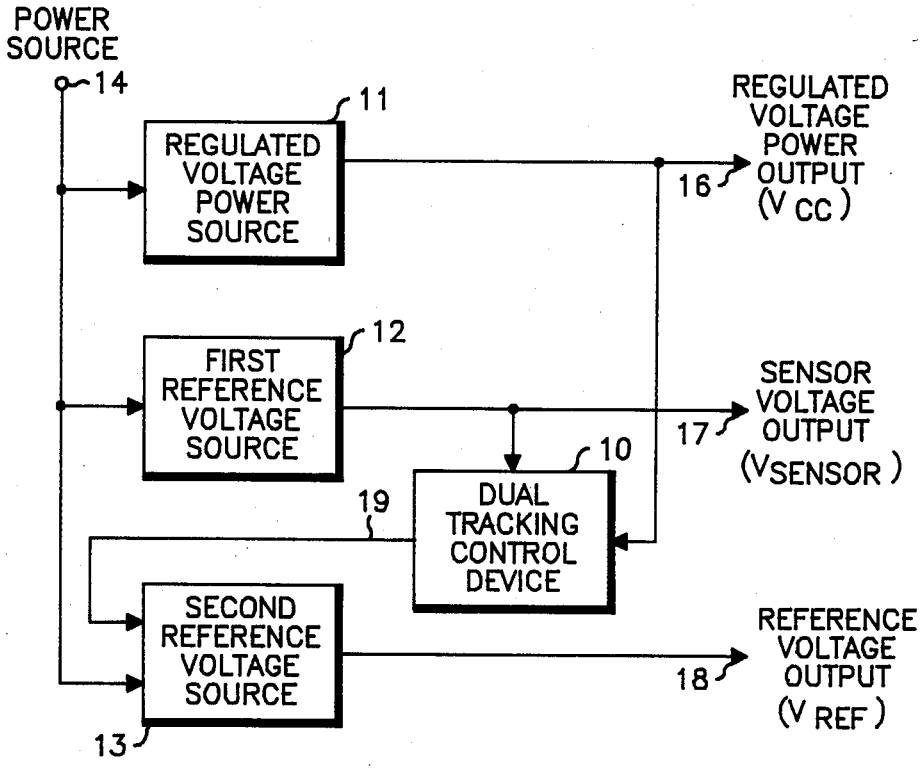
FIG. 4 comprises a block diagram view of a second embodiment.

Referring to FIG. 4, an alternative embodiment will be described. This embodiment is identical to that embodiment described with respect to FIG. 1, with the exception that the first reference voltage source (12) does not respond to a 1.25 volt regulated reference voltage output as provided in FIG. 1. Rather, the first reference voltage source (12) can be provided through use of a similar part as utilized to comprise the regulated voltage power source (11).

The dual tracking control device unit (10) will still be responsive to the sensor voltage output (17) and the regulated voltage power output (16). So long as the regulated voltage power output (16) and the sensor voltage output (17) maintain a predetermined relationship with respect to one another, the reference signal (19) provided to the second reference voltage source (13) will be based upon the sensor voltage output (17). If the regulated voltage power output (16) and the sensor voltage output (17) fail to maintain the predetermined relationship, the tracking control unit (10) will provide a reference signal (19) that tracks the regulated voltage power output (16) instead.

Viewed another way, it may be said that the dual tracking control device (10) operates to maintain the $V_{ref}$ signal within a predetermined relationship as regards the $V_{sensor}$ signal (this relationship comprising a first range of allowable values) so long as the $V_{sensor}$ signal remains in a predetermined relationship with the $V_{cc}$ signal. At the same time, the device assures that the $V_{ref}$ signal will always be maintained within a particular range of the $V_{cc}$ signal. So long as the $V_{ref}$ signal stays within this latter range, it can track the $V_{sensor}$ signal. If tracking the $V_{sensor}$ signal would cause the $V_{ref}$ signal to exceed in any way this allowable range with respect to the $V_{cc}$ signal, then the $V_{ref}$ signal will stop tracking the $V_{sensor}$ signal.

Those skilled in the art will recognize a variety of variations and modifications that could be made with respect to the above described embodiments that would not depart from the spirit of the invention. The scope of the invention should therefore not be considered as limited to the specific embodiments set forth, unless such limitations are specifically set forth in the claims.

I claim:

1. A dual tracking control device for use with a multiple voltage source system having at least an input for receiving a substantially unregulated DC voltage, a regulated voltage power source for providing a first voltage, a first reference voltage source for providing a second voltage, and a second reference voltage source for providing a third voltage, said dual tracking control device comprising:

(a) tracking control means being responsive to said first voltage and said second voltage and further having an output for providing a reference signal to said second reference voltage source to control said third voltage, such that:

(i) said third voltage will substantially track said second voltage when said second voltage substantially maintains a predetermined relationship with respect to said first voltage; and (ii) said third voltage will substantially track said first voltage when said second voltage and said first voltage do not substantially maintain said predetermined relationship.

2. The device of claim 1 wherein said predetermined relationship between said first voltage and said second voltage requires that said first voltage substantially equal said second voltage.

3. The device of claim 2 wherein so long as said predetermined relationship between said first voltage and said second voltage is maintained, said first voltage will substantially equal said second voltage and said third voltage.

4. The device of claim 3 wherein when said predetermined relationship between said first voltage and said second voltage is not substantially maintained, said third voltage will substantially equal said first voltage.

5. The device of claim 1 wherein said tracking control means functions to maintain said third voltage within a specific range as regards said first voltage, and within a second range as regards said second voltage.

6. The device of claim 5 wherein said tracking control means additionally functions to always maintain said third voltage within said first range.

7. The device of claim 6 wherein said tracking control means further functions to maintain said third voltage within said second range only if such maintenance will not cause said third voltage to not be maintained outside of said first range.

8. The device of claim 1 wherein said second reference voltage source comprises a unity gain amplifier.

9. The device of claim 8 wherein said reference signal provided by said tracking control means substantially equals said second voltage if said first voltage and said second voltage are within said predetermined relationship.

10. The device of claim 9 wherein said reference signal as provided by said tracking control means will substantially equal said first voltage if said first voltage and said second voltage are not within a said predetermined relationship.

11. The device of claim 1 wherein said tracking control means includes two parallel configured back-to-back Schottky diodes that are connected between said regulated voltage power source and said second reference voltage source.

12. The device of claim 11 wherein said diodes connect between an output of said regulated voltage power source and an input of said second reference voltage source.

13. The device of claim 12 wherein said diodes further operably connect to an output of said first reference voltage source.

14. A dual tracking control device for use with a multiple voltage source system having at least an input for receiving a substantially unregulated DC voltage, a regulated voltage power source for providing a first voltage, a first reference voltage source for providing a second voltage, and a second reference voltage source for providing a third voltage, said dual tracking control device comprising:

(a) tracking control means having an output for providing a reference signal to said second reference voltage source to control said third voltage, and further being responsive to said first voltage and said second voltage, such that;

(i) said reference signal will be substantially supplied by said first reference voltage source when said second voltage substantially equals said first voltage; and (ii) said reference signal will be substantially supplied by said regulated voltage power source when said second voltage does not substantially equal said first voltage.

15. A dual tracking control device for use with a multiple voltage source system having at least an input for receiving a substantially unregulated DC voltage, a regulated voltage power source for providing a first voltage, a first reference voltage source for providing a second voltage, and a second reference voltage source for providing a third voltage, said dual tracking control device comprising:

(a) tracking control means having an output for providing a reference signal to said second reference voltage source to control said third voltage, said tracking control means being responsive to said first voltage and said second voltage, such that:

(i) said third voltage will substantially maintain a predetermined relationship with respect to said second voltage, provided that said second voltage substantially maintains a predetermined relationship with respect to said first voltage; and (ii) said third voltage will substantially maintain a predetermined relationship with respect to said first voltage if said second voltage fails to maintain said predetermined relationship with respect to said first voltage.

16. A dual tracking control device for use with a multiple voltage source system having at least an input for receiving a substantially unregulated DC voltage, a regulated voltage power source for providing a first voltage, a first reference voltage source for providing a second voltage, and a second reference voltage source for providing a third voltage, said dual tracking control device comprising:

(a) tracking control means having an output for providing a reference signal to said second reference voltage source to control said third voltage, said tracking control means being responsive to said first voltage and said second voltage, such that said third voltage will be maintained:

(i) within a first range with respect to said first voltage; and (ii) within a second range with respect to said second voltage if maintenance of said third voltage within said second range will not result in said third voltage being outside said first range.

* * * * *